United States Patent [19]

Ueno

[11] Patent Number: 5,038,671

[45] Date of Patent: Aug. 13, 1991

[54] CONTROL VALVE

[75] Inventor: Katsumi Ueno, Higashimatsuyama, Japan

[73] Assignee: Diesel Kiki Co., Ltd., Tokyo, Japan

[21] Appl. No.: 333,581

[22] Filed: Apr. 5, 1989

[30] Foreign Application Priority Data

Apr. 14, 1988 [JP] Japan ..... 63-90329

[51] Int. Cl.[5] ..... F15B 11/04

[52] U.S. Cl. ..... 91/517; 60/426; 60/427; 60/459; 91/446; 91/531; 137/596.13

[58] Field of Search ..... 91/512, 517, 518, 446, 91/447, 466, 531; 60/426, 427, 459, 420, 468; 137/596.13

[56] References Cited

U.S. PATENT DOCUMENTS

| | | | |
|---|---|---|---|
| 3,881,512 | 5/1975 | Wilke | 137/596.13 |
| 4,020,867 | 5/1977 | Sumiyoshi | 91/446 |
| 4,112,679 | 9/1978 | Buzdich | 60/459 |
| 4,253,382 | 3/1981 | Yip | 91/517 |
| 4,515,181 | 5/1985 | Dezelan | 91/446 |
| 4,548,239 | 10/1985 | Eskildsen | 91/446 |
| 4,736,770 | 4/1988 | Rousset et al. | 91/446 |

FOREIGN PATENT DOCUMENTS

| | | | |
|---|---|---|---|
| 0052603 | 5/1981 | Japan | 91/446 |
| 0052605 | 5/1981 | Japan | 91/531 |
| 59-186502 | 12/1984 | Japan . | |
| 61-10707 | 3/1986 | Japan . | |

*Primary Examiner*—Edward K. Look
*Assistant Examiner*—Christopher M. Verdier
*Attorney, Agent, or Firm*—Wenderoth, Lind & Ponack

[57] ABSTRACT

A control valve is disclosed for use in controlling flow of hydraulic fluid from a hydraulic pump to a plurality of actuators. The control valve includes a valve housing within which are formed control bores, pressure-compensating bores, a feed passage communicating between the pressure-compensating bores, a selected-load pressure transmitting passage communicating between the pressure-compensating bores, a pair of return passages communicating between the control bores and a reservoir tank, control passages communicating respectively between each of the control bores and each of the pressure-compensating bores, and feeding and exhausting passages, as well as actuator ports, communicating between the control bores and the actuators. Control valve spools are slidably mounted, respectively, in the control bores, and pressure-compensating valves are slidably mounted, respectively, the pressure-compensating bores. One end of each of the pressure-compensating valves is subject to fluid pressure from the hydraulic pump and the other end is subject to fluid pressure due to loads of respective ones of the actuators. Shuttle valves are mounted in all but one of the pressure-compensating bores and are adapted to allow communication between either upstream and downstream portions of the selected-load pressure transmitting passage or between respective ones of the control passages and the downstream portion of the selected-load pressure transmitting passage. An unload valve is provided to connect the feed passage with the reservoir tank during periods of particular actuator loads.

9 Claims, 4 Drawing Sheets

CONTROL VALVE

FIELD OF THE INVENTION

This invention relates to a control valve, in which a single valve housing is disposed and which, along with various component elements, is formed as one integral body, such that the structure is simplified, and machining and assembly of the component parts are smoothly and systematically performed and in which a hydraulic oil, having a pressure corresponding to variations of the loads of a plurality of actuators, can be simultaneously and constantly fed to the actuators.

DESCRIPTION OF THE PRIOR ART

In general, civil engineering machines and construction machines are quipped with a plurality of hydraulic actuators which are capable of various operations, and operation thereof is controlled by various hydraulic control valves. Therefore, it is necessary for this kind of hydraulic control valve to be fed with hydraulic oil in an amount corresponding to load conditions of each actuator which vary continuously. In addition, component parts must be formed integrally, and smooth machining and systematic assembly are required. A prior art control valve meeting such requirements is disclosed in Japanese Patent publication No. Sho 61-10707. That is, this publication shows a stack type compound valve comprising a plurality of directional control valves capable of controlling a flow rate. The valves include a discharging passage for discharging a load pressure of the actuators to an adjacent surface portion, a shuttle valve disposed on the adjacent surface of the discharging passage, and an intake passage for receiving a load pressure selected by the shuttle valve. This control valve also includes pressure control valves stacked one upon the other in several laminations with respect to the directional control valves. These stacked valves are integrally joined by stud bolts. The maximum load pressure of the plurality of actuators is selectively introduced by the shuttle valve and is caused to act on the pressure control valve. The plurality of actuators are simultaneously activated by controlling the feeding pressure of a pump, groups of various valves including the shuttle valve being assembled systematically.

By this conventional stack type compound valve, the various actuators can simultaneously be operated even when the load pressure of respective actuators is different.

However, there still remained unsolved problems, such as the fact that when the load pressure of the individual actuators was to be varied during operation, it was necessary to change the operating speed of the actuators unless the flow rate to the actuators was controlled by continuously operating the corresponding flow rate directional control valve.

Also, according to the drawings in the above-mentioned publication, since a discharge passage and an intake passage connected to the shuttle valve are disposed within a bent-shaped housing of each flow rate directional control valve, complicated machining is required and productivity is jeopardized.

In order to solve these problems, the present applicant proposed a pressure-compensating directional-control valve in Japanese Utility Model Application No. Sho 63-46811 (not yet published) comprising a plurality of housings stacked up one upon another in several layers. Each of the housings of this valve has a vertical hole formed therein and communicated with a valve bore containing a flow rate directional control spool. The hole is provided therein with a pressure compensating valve which automatically correspondingly controls a flow rate of oil to be fed to the actuator without operating the spool when the load pressure of the corresponding actuator is varied. An oil passage connected with a shuttle valve within each of the housings is linearly disposed relative to an adjacent surface.

The above-mentioned stack type control valve has the advantage that a required number of flow rate directional-control valves can be suitably assembled in accordance with the number of actuators required by the parent machine. On the other hand, it has the disadvantages that oil tends to leak from the laminated surface portion of each of the flow rate directional-control valves, the weight is increased when many of them are joined because strength must be ensured for each valve body, and the strength of the overall combination with respect to vibrations of the parent machine is questionable.

As one solution for the above problems, various elements may simply be assembled or mounted in a single housing as disclosed in Japanese Utility Model Application Early Laid-Open Publication No. Sho 59-186502. However, this solution is unable to satisfy the requirement of a control valve wherein a shuttle valve element is indispensable because the shuttle valve is arranged utilizing the adjoining surface portions of the prior art flow rate directional-control valves.

Therefore, the present applicant proposed, in Japanese Patent Application No. Sho 63-37419, a shuttle valve device in which a block-like apparatus body is formed with a communication passage linearly extending therein with a mounting hole perpendicular to the communication passage, the mounting hole receiving a shuttle valve at one end thereof. A pressure introduced into one side of the shuttle valve device through the communication passage is compared with a pressure introduced therein through a foremost end of the mounting hole, and, based upon the comparison, one of the pressures is selected and the oil is guided to the communication passage portion at the other side of the shuttle valve.

Also, the present applicant proposed, in Japanese Utility Model Application No. 63-19889, a shuttle valve in which a single block is formed therein with two passages forming control systems. The passages were formed with a plurality of spool openings which communicate with actuators and have shuttle valves mounted therein. A final shuttle valve is disposed between the downstream side shuttle valves received in respective control systems. The oil having the maximum pressure of the two control systems is guided to the shuttle valve, and then fed to a control valve.

SUMMARY OF THE INVENTION

A first object of the present invention is to provide an improved control valve comprising a hydraulic pump for feeding an operating oil under pressure, an oil tank adapted to reserve therein the operating oil, a directional control valve for feeding and exhausting operating oil to and from each actuator, a pressure-compensating valve for adjusting pressure in correspondence to load variations during the activation of the individual actuators, a shuttle valve for selecting the maximum pressure of the load pressure of the various actuators, and an unload valve for feeding such selected operating fluid having the maximum load pressure to the actuator. At least the directional-control valves, the pressure-compensating valves and the shuttle valves are integrally mounted in the control valve.

Another object of the present invention is to provide a control valve, which is simple in structure, which is easy to machine and assemble and which allows for increased productivity.

A further object of the present invention is to provide a control valve in which hydraulic oil having a pressure and flow rate corresponding to the load of a plurality of actuators can always be continuously fed even when the load varies.

A control valve according to the present invention includes a hydraulic pump for feeding an operating fluid under pressure, a directional control valve for controlling the feeding and exhausting operation of a hydraulic oil to and from each actuator, a pressure-compensating valve for adjusting a feed flow rate corresponding to load variations during activation of the individual actuators, a shuttle valve for selecting the maximum pressure from the load pressures of the actuators, and an unload valve for feeding a hydraulic oil based on such selected maximum load pressure to the actuator. At least the directional-control valve, the pressure-compensating valve, and the shuttle valve are integrally mounted in the control valve. The improvement comprises a valve housing formed therein with a feed passage communicated with the hydraulic pump through an oil conduit tube, and an oil discharge passage communicated with an oil tank through an oil discharge tube. A plurality of spaced apart control bores are disposed in a single plane within the housing in parallel relation with each other. The control valve further includes a pair of discharge oil passages perpendicular to the control bores in a single plane and communicated with the oil tank, spools as directional-control valves slidably accommodated in the control bores, and an actuator port communicated with the spools through a feeding and exhausting passage. The actuator port is opened and closed according to displacement of the spool so as to enable feeding and discharge of hydraulic oil to and from the corresponding actuator. A number of pressure-compensating bores corresponding to the number of control bores are arranged in a similar manner as the control bores in a single plane and perpendicular to the feed oil passage at one end portion thereof. A pair of oil passages and control oil passages are provided for intercommunicating a pair of corresponding but spaced apart control bores and pressure-compensating bores. A pressure-compensating valve is slidably accommodated within each of the pressure-compensating bores, one end of the pressure-compensating valve being acted against by oil from a pump and the other end thereof being acted against by oil having a pressure corresponding to the load of the actuator, through said control oil passage. A single selected-load pressure transmitting oil passage is formed perpendicular to the pressure-compensating bore at the other end side of the feed oil passage in the same plane as the pressure-compensating valve. A shuttle valve is disposed at an intersection of the selected-load pressure transmitting oil passage and the pressure-compensating bore and has a valve chest provided with three openings communicated with upstream and downstream sides of said selected-load pressure transmitting oil passage. The shuttle valve selects a high pressure side from the upstream side load pressure of the load transmitting oil passage introduced to the valve chest and the pressure compensating bore side load pressure in order to permit only the high pressure oil to flow to the downstream side of the selected-load pressure transmitting oil passage. An unload valve is provided to permit hydraulic oil to cope with the maximum load pressure of the load pressures of the plurality of actuators sequentially selected by the shuttle valve to be fed to a feed oil passage by the hydraulic pump.

The above objects, features and advantages of the present invention will become more apparent from the following detailed description with reference to the accompanying drawings.

DETAILED DESCRIPTION OF THE PREFERRED EMBODIMENT

Figure 1:
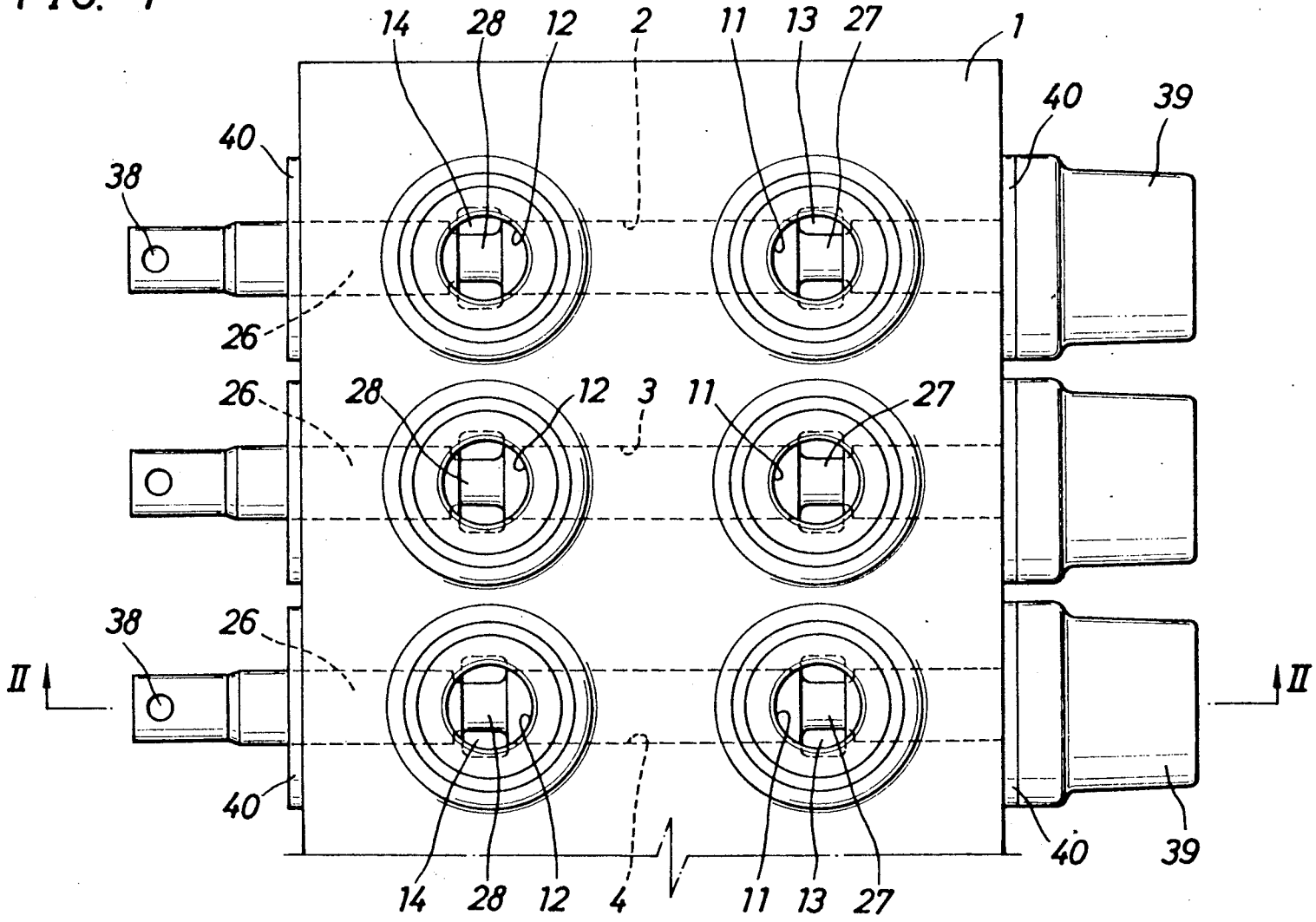
FIG. 1 is a plan view showing an outer appearance of the present invention.

The present invention will now be described with reference to the illustrated embodiment in which the present invention is applied to a so-called mono-block type control valve. In FIG. 1 through FIG. 4, 1 denotes a generally rectangular board-shaped valve housing provided with various oil passages formed by casting as will be described. Control bores 2,3,4 are disposed within the valve housing 1 such that they are spaced apart and in parallel in a single plane. Pressure-compensating bores 5,6,7 corresponding to the control bores 2,3,4, respectively, are disposed in spaced apart parallel relation in a plane parallel to the plane of the control bores 2,3,4.

Each control bore 2,3,4 is provided with return oil passages 9,10 opening at an inner peripheral surface thereof and in communication with an oil tank 8. The return oil passages 9,10 are disposed perpendicularly of and in the same plane as the control bores 2,3,4. The control bores 2,3,4 are provided with feeding and exhausting passages 13,14 opening at an inner periphery thereof and in communication with actuators (not shown) via actuator ports 11, 12 and oil conduit tubes 15,16

Each of the control bores 2,3,4 is provided with a generally inverted U-shaped terminal oil passage 17 which opens into the bores between the feeding and exhausting passages 13,14. At least one side opening portion of the terminal oil passage 17 is aligned with a send oil passage 18 for intercommunicating the pressure-compensating bores 5,6,7. The control bores 2,3,4 are provided with a control oil passage 19 opening at a central portion of the housing 1 and communicating with the pressure control bores 5,6,7.

Also, in the same plane as the pressure-compensating bores 5,6,7 within the housing 1, a feed oil passage 21 is formed and communicates with a hydraulic pump 20, a selected load pressure transmitting oil passage 23 is formed and communicates with an unload valve 22 through an oil passage. The oil passages 21,23 are disposed in parallel spaced apart relation, are perpendicular to the bores 5,6,7 and open at an end face of the housing 1. Bull plugs 24,25 are provided respectively for an end of each of the oil passages 21,23.

Each of the control bores 2,3,4 is provided with a directional control valve spool 26 slidably accommodated therein. The spool 26 is formed on its peripheral surface with spaced apart passages 27,28.

Each of the spools 26 has center holes 29,30 formed therein and extending to the axial center thereof. These holes 29,30 are communicated with conduit holes 31,32 and with a passage hole 33. The holes 31,32 open near the peripheral surfaces of the passages 27,28, whereas the passage hole 33 opens at central position on the peripheral surface of the spool 26. The arrangement is such that when the spool 26 is in its neutral position, the conduit holes 31,32 are communicated with the return oil passages 9,10 and the passage hole 33 is communicated with the control passage 19.

The center holes 29, 30 open through the end faces of the spools 26, and connecting bolts 34,35 are fluid-tightly bolted thereinto. The connecting bolt 34 is provided with a pair of retainers 26,26 retained thereon in opposing relation. Interposed between the retainers 36,36 is a spring 37 through which the spool 26 is held in its neutral position.

Also, the other connecting bolt 35 has a head portion formed into a U-shaped configuration so that a driving rod (not shown) can be connected thereto, and end portions thereof are formed with a through-hole 38 for permitting bolts (not shown) to be inserted therein. In the figures, 39 denotes a hollow cylindrical cap. The cap 39 accommodates therein the retainers 36,36. 40,40 denote plates mounted on end faces of the valve housing 1.

Figure 3:
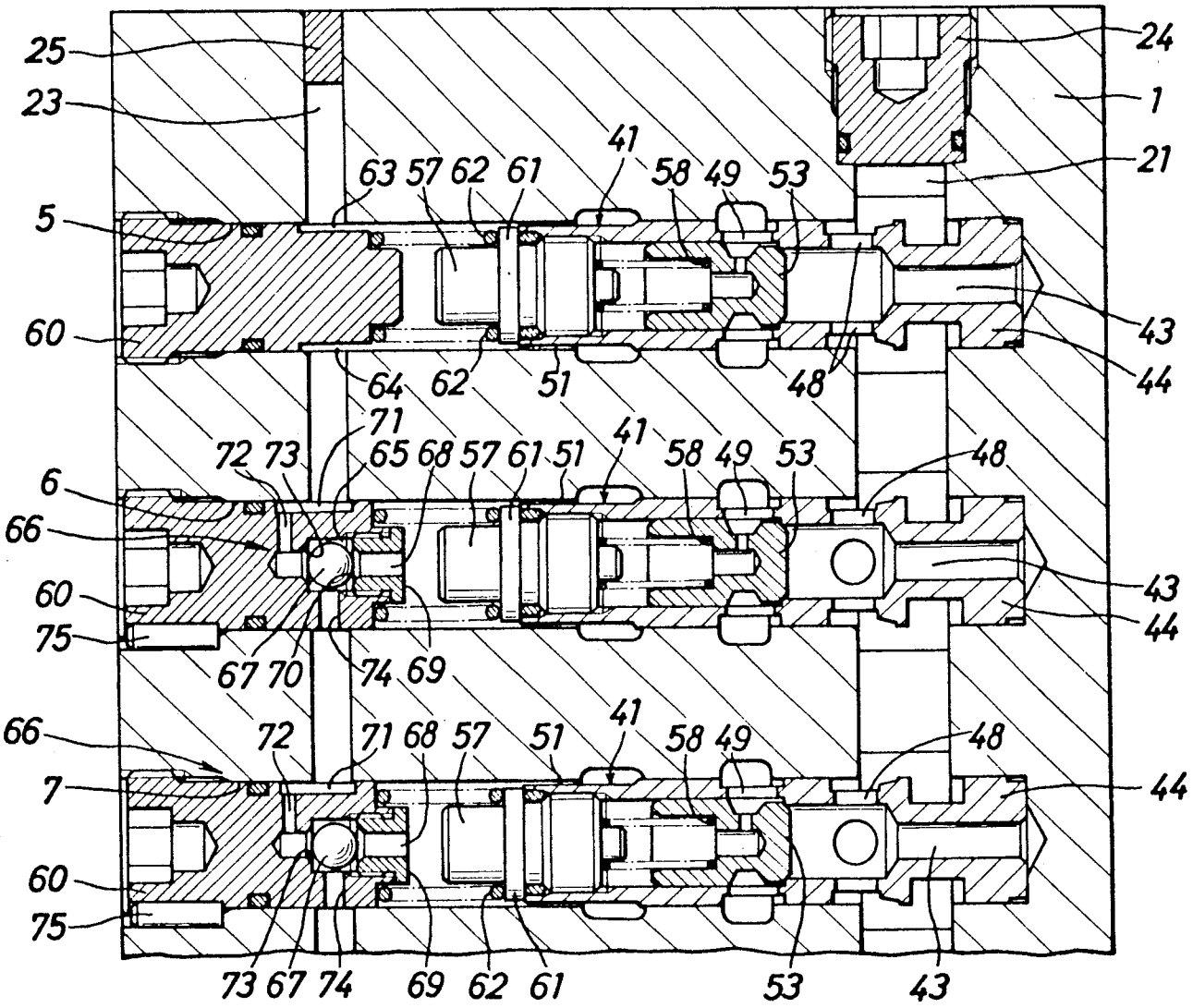
FIG. 3 is a cross sectional view taken along line III—III of FIG. 2.

On the other hand, each of the pressure-compensating bores 5,6,7, as shown in FIG. 3, is blocked at one end thereof and opens at the other end thereof through the end face of the housing I at the same side as the connecting rod 35. The bores 5,6,7 are provided with substantially similar pressure-compensating valves 41,41,41 slidably accommodated therein.

Each of the pressure-compensating valves 41 is formed of a hollow cylindrical slide spool and has formed therein a stepped valve hole 42 and a through-hole 43 communicating with each other and opening at opposing end faces of the valve 41. The pressure-compensating valve 41 is provided with a plurality of spaced apart land portions 44,45,46,47 arranged on the outer peripheral surface thereof. An end portion of the land portion 44 positioned at the axial end thereof is able to abut with the blocked end of each of the pressure-compensating bores 5,6,7.

Between the land portions 45 and 46, and between the land portions 46 and 47, there are formed through-holes 48,49 communicating with the valve hole 42. The through-hole 48 which is able to communicate with the send oil passage 18 is adjusted with respect to its degree of opening by engagement between the land portions 45,46 and the inner peripheral surface of the pressure-compensating bore 5, thus enabling adjustment of the flow rate of the hydraulic oil from an oil conduit tube as will be described. The peripheral surface of its end portion adjacent to the land portion 47 is formed somewhat small in diameter. An annular oil passage 51 is formed between the small diameter axial portion 50 and the inner peripheral surfaces of the respective pressure-compensating bores 5,6,7 for permitting the portion 50 to reciprocally move therealong. A stepped-peripheral edge positioned at the intersecting portion between the through-hole 49 and the valve hole 42 is formed with a seat 52. A load check valve 53 is disposed in such a manner as to be engagable with the seat 52. The valve 53 is slidably accommodated within the valve hole 42 and is formed as a hollow cylinder having an open end and a closed end. The shoulder portion at its bottom (i.e. closed end) serves as a valve surface and has an annular groove 54 formed about its periphery. The groove 54 is formed with a through-hole 55 communicated with the interior of the valve.

On the other hand, the valve hole 42 is formed on the inner peripheral surface of its opening end portion with a threaded portion 56. A fixing bolt 57 is fluid-tightly bolted into the portion 56. Interposed between the inner end portion of the bolt 57 and the valve 53 is a weak spring 58 through which the valve 53 is biased in its opening direction so as to be engaged with the seat 52.

The opening end portion of each of the pressure-compensating bores 5,6,7 is provided with a threaded portion 59 to which a shuttle housing 60 is fluid-tightly secured. The housing 60 is formed of a cylindrical body long enough to block the selected-load transmitting oil passage 23. Interposed between the inner end portion of the housing 60 and a flange 61 formed on the fixing bolt 57 is a set spring 62 much stronger than the spring 58 which is adapted to bias the pressure-compensating valve 41 in the blocking end portion of the pressure-compensating bores 5,6,7.

The shuttle housing 60 mounted in the bore 5 positioned at the innermost part of the feed oil passage 21 is blocked at its inner end face and is formed small in diameter at its peripheral surface around its portion which intersects with the oil passage 23. Between the small diameter axial portion 63 thereof and the inner peripheral surface of the bore 5, there is formed an annular oil passage 64 communicated with the oil passage 23 at both sides thereof and with the bore 5.

Also, each of the remaining (i.e. other than the housing 60 disposed in bore 5) shuttle housings 60 is provided with a valve chest 65 opening through the inner end face of the shuttle housing 60. The chest 65 is provided with, for example, a ball-like valve body 67 forming a shuttle valve 66.

The valve chest 65 is provided with a stop screw 69 formed with a passage hole 68 and threaded into its opening portion, and the peripheral edge of the inner opening portion thereof is formed with a seat 70 for seating of the valve body 67. Also, the housing 60 including the valve chest 65 is provided at the portion of its peripheral surface which intersects with the selected-load pressure transmitting oil passage 23 opposite the upstream side of the hydraulic oil flow with a depressed hole 71 communicated with the oil passage 23. The hole 71 is communicated with the valve chest 65 through a conduit hole 72. In the figures, 73 denotes a seat formed on the bottom portion of the valve chest 65. The seat 73 permits the valve body 67 to sit thereon.

On the other hand, the shuttle housing 60 is provided with an outlet port 74 opening at the peripheral surface thereof opposite the depressed hole 71, i.e., the peripheral surface of the housing 60 opposite the downstream side of the hydraulic oil flow and communicated with the valve chest 65, so that the high pressure side hydraulic oil can flow into the downstream side of oil passage 23.

In the figures, 75 denotes a positioning pin inserted between the peripheral end portion of the shuttle housing 60 and the bores 6,7, 76 denotes a relief valve, and 77 denotes an oil conduit tube connected with one end of the feed oil passage 21. In the above-mentioned embodiment, the unload valve 22 may be integrally mounted in a suitable portion of the valve housing 1 such as, for example, the end portion thereof.

The control valve generally comprises the valve housing 1 and the plurality of spools 26, the plurality of pressure-compensated valves 41, and the plurality of shuttle housings 60 with the shuttle valves 66 mounted therein. In regard to the valve housing 1, the peripheral surfaces of the control bores 2,3,4 and the pressure-compensating bores 5,6,7 are smoothed by machining.

The feed oil passage 21 and the selected-load pressure transmitting oil passage 23 which are perpendicular to the control bores 2,3,4 and the pressure-compensated bores 5,6,7 respectively, may be shaped by machining or casting.

In this way, the interior part of the valve housing 1 which has been subjected to machining is provided, as shown in FIG. 1 through FIG. 4, with a plurality of units consisting of vertically disposed pairs of the control bores 2,3,4 and the pressure-compensated bores 5,6,7. The feed oil passage 21 and the selected-load pressure transmitting oil passage 23 are disposed perpendicular to the bores 2,3,4 and 5,6,7. The housing structure is particularly simplified in that the selected-load pressure transmitting oil passage 23 is commonly used as a transmitting passage for the selected-load pressure of all the shuttle valves 66. Also, by forming the housing 1 in a linear shape, the shaping and/or machining is easier.

Moreover, in a shuttle valve requiring, as essential component elements, a flow passage of a pair of comparative load pressures (an upstream load pressure and a load pressure of its adjacent actuator) and a passing flow passage of a hydraulic oil at the high pressure side, the shuttle housing 60 and the pressure-compensating valve 41 are accommodated in the same pressure-compensating bores 5,6,7 and the bores 67 are commonly used as a transmitting oil passage of hydraulic oil with respect to the shuttle valve 66 as will be described. Accordingly, they can be arranged in perpendicular relation on the same plane. Therefore, the arrangement, machining and the number of assembly steps can be simplified, and the arrangement thereof can be made compact.

Also, by commonly using the pressure-selected oil passage 23 as the remaining transmitting oil passage with respect to the shuttle valve 66, the complexity of the structure and machining can be reduced when compared with a case in which the feeding and exhausting passages are separately provided.

When the spools 26, the pressure-compensating valves 41, etc. are mounted in the valve housing 1, the spools 26 are inserted into the control bores 2,3,4. Also, the pressure-compensating valves 41 with the load check valves 53 and the fixing bolts 57 mounted therein are accommodated in the pressure-compensating bores 5,6,7. Thereafter, the shuttle housings 60 with the shuttle valves 66 mounted therein are threadedly inserted into the opening portions of the bores 5,6 to block the openings thereof.

In this case, when the shuttle housing 60 is to be assembled, the housing 60 which does not include the shuttle valve 66 is mounted in the pressure-compensating bore 5 which opens at the innermost part of the feed oil passage 21, whereas the housings 60 having the shuttle valves 66 therein are mounted in the remaining pressure-compensating bores 6,7.

At that time, the housing 60 is positioned such that the depressed holes 71 and the outlet ports 74 open into the selected-load transmitting oil passage 23 and the depressed holes 71 open at the upstream side of the oil passage 23. When they have been correctly positioned, the pin 75 is inserted therein in order to fix the position thereof.

Therefore, if the flowing direction of hydraulic oil is changed in the selected-load pressure transmitting passage 23, for example, the housing 60 is rotated by 180 degrees in order to switch the position of the depressed holes 71 with respect to the position of the outlet port 74. Due to the foregoing arrangement, it is unnecessary to exchange component parts in such a situation, and it is thus unnecessary to maintain such parts on hand.

In this case, the pin holes of the pins 75 can be disposed at the above-mentioned position as well as a position located 180° therefrom.

Thereafter, the connecting bolts 34,35 are threadedly inserted into the end portions of the respective spools 26. The connecting bolt 34 is attached with the retainer 36 and the cap 39, whereas the other connecting bolt 35 is connected with a driving rod (not shown). Also, the actuator ports 11, 12 are connected with the oil conduit tubes 15,16 which communicate with the actuators (not shown). One end of the feed oil passage 21 is connected with the oil conduit tube 77 which communicates with the hydraulic pump 20. The other end of the feed oil passage 21 as well as one end of the selected-load pressure transmitting oil passage 23 have the bull plugs 24,25 inserted therein, respectively, to block the openings thereof. At this point, the assembly of the control valve is complete.

Figure 2:
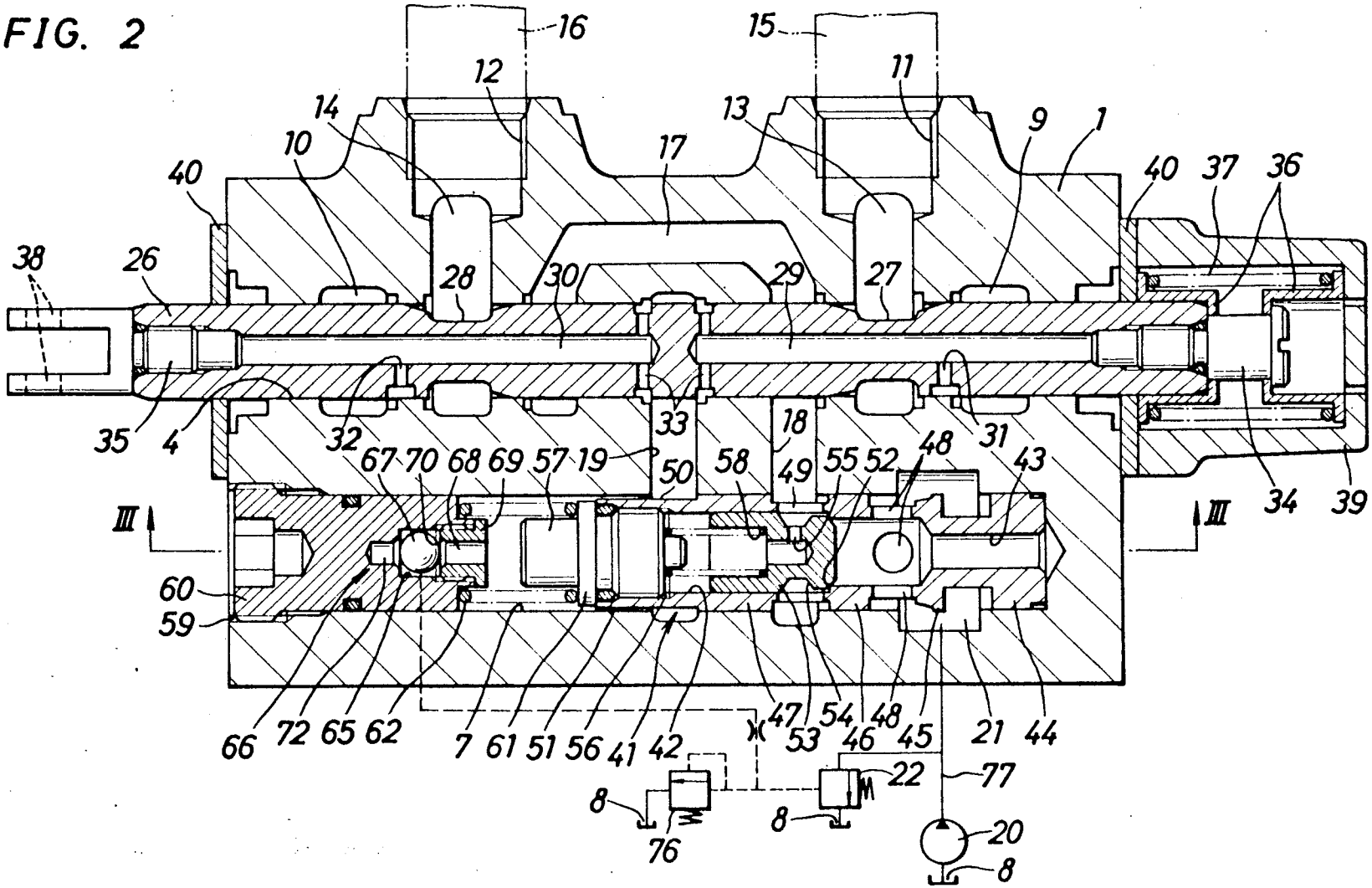
FIG. 2 is a vertical sectional view taken along line II—II of FIG. 1.

In the control valve, the terminal oil passage 17 and the oil passages 13,14, as shown in FIG. 2 and FIG. 3, are cut off with respect to each other through the send oil passage 18 when the spools 26 are in a neutral position. On the other hand, the return oil passages 9,10, which are communicated with the oil tank, are communicated with the center holes 29,30 through the conduit holes 31,32 formed in the spools, and further communicated with the control oil passage 19 through the passage hole 33 opening into the holes 29,30.

The oil passage 19 is communicated with the annular oil passage 51, and the oil passage 51 is communicated with the respective one of the pressure-compensating bores 5,6,7 between the pressure-compensating valve 41 and the shuttle housing 60. Therefore, the pressure-compensating bores 5,6,7 are communicated with the oil tank, and thus, no pressure is generated.

Also, the pressure-compensating valves 41, when the spools 26 are in the neutral position, are biased in the feed oil quantity increasing direction by the set springs 62. The end portion of each of the land portions 44 formed on one end of each of the valves 41, respectively, is respectively engaged with the closed end of one of the pressure-compensating bores 5,6,7 and is held stationary . On the other hand, the load check valve 53 mounted therein is biased in the valve closing direction through the spool 58 in order to cut off the communication between the feed oil passage 21 and the send oil passage 18 with its end face urged against the seat 52.

Furthermore, the selected-load pressure transmitting oil passage 23 is communicated with the pressure-compensating bores 5,6,7, which are in a zero pressure state, through the annular oil passage 64 and the passage hole 68. Therefore, the valve chests 65,65 communicated therewith are also in the same pressure state, and the valve bodies 67,67 are held stationary.

Figure 4:
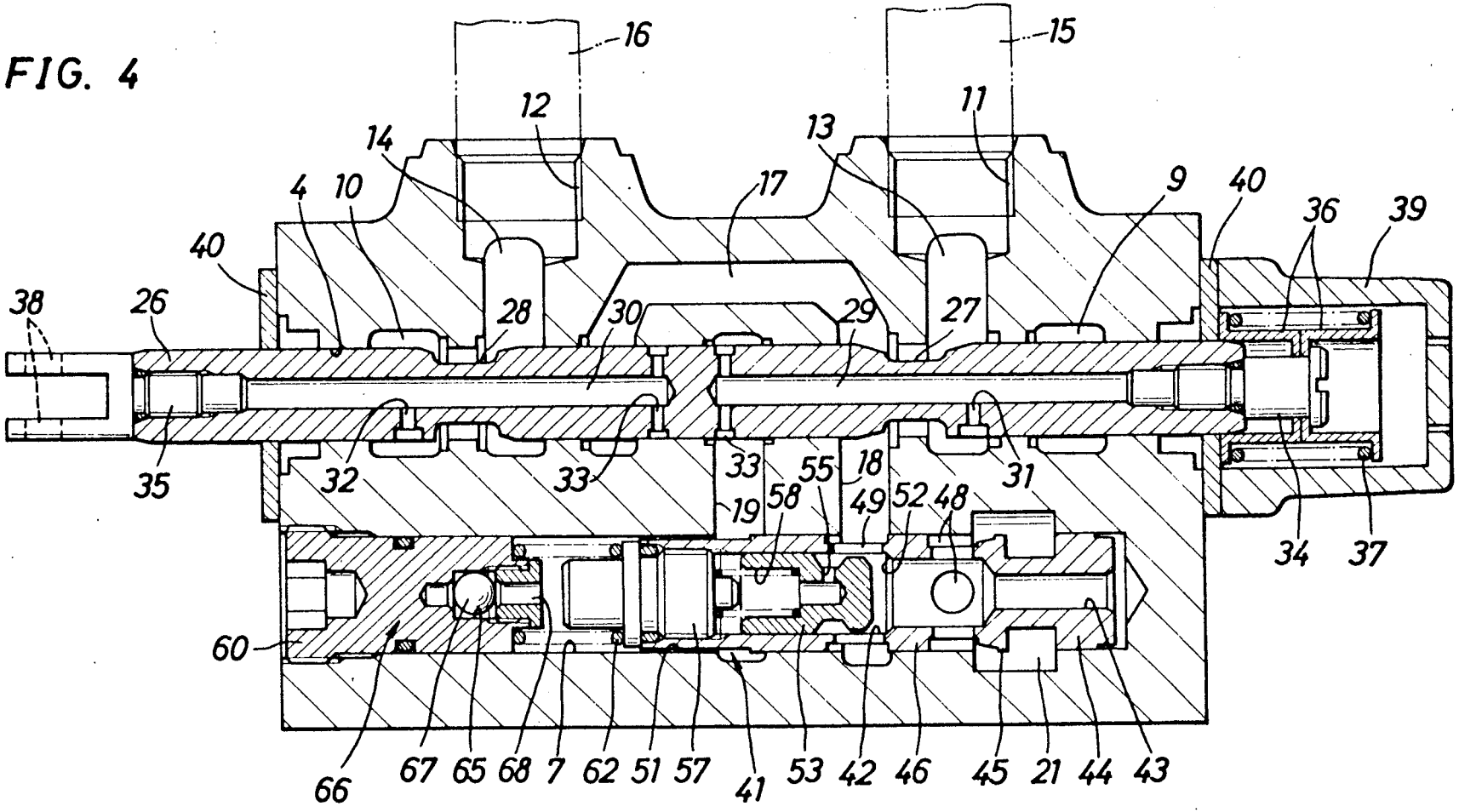
FIG. 4 is a sectional view showing an operating state of the present invention.

Under the above-mentioned circumstance, when the spool 26 is moved in, for example, the left-hand direction in FIG. 2 through an operating lever (not shown), the spool 26 is switched to a position, for example, as shown in FIG. 4.

That is, communication between the return oil passages 9,10 and the control oil passage 19 is cut off. In turn, the send oil passage 18 and the terminal oil passage 17, and the oil passage 13 are communicated with each other through the passage 27. Also, the oil passage 13 and the control oil passage 19 are communicated with each other through the conduit hole 31, the passage hole 33 and the center hole 29. On the other hand, the oil passage 14 and the return oil passage 10 are communicated with each other through the other passage 28.

Therefore, hydraulic oil within the feed oil passage 21 communicated with the oil conduit tube 77 flows into the valve hole 42 through the passage hole 48. The load check valve 53 is pushed in the left-hand direction in FIG. 4 by the hydraulic oil against the spring 58 to push open the flow passage between the valve 53 and the seat 52, and as a result, the hydraulic oil flows into the send oil passage 18.

The hydraulic oil introduced to the send oil passage 18 flows into the oil passage 13 and is then introduced into the actuator (not shown) from the oil passage 13 through the oil conduit tube 15 connected with the actuator port 11.

On the other hand, return oil from the actuator flows into the cylinder port 12 through the oil conduit tube 16, is introduced into the return oil passage 10 via the oil passage 14 and the passage 28 and is then returned to the oil tank 8.

In this hydraulic oil feeding and exhausting process, when the respective actuators are actuated, the load pressure thereof continuously fluctuates due to load variation of the respective actuators. Pressure thereof is the same as the pressure within the oil passage 13 communicated with the port 11. A part of the hydraulic oil is introduced into the respective control oil passages 19 from the conduit holes 31 via the center holes 29 and the passage holes 33.

The hydraulic oil is further introduced into the pressure-compensating bores 5,6,7 between the pressure-compensating valves 41 and the shuttle housing 60 from the control oil passages 19 via the annular oil passages 51, and then acts on one end of each of the respective pressure-compensating valves 41 and the shuttle valves 66.

Therefore, one end of the pressure-compensating valve 41 is acted upon by hydraulic oil at the same pressure as the discharging pressure of the hydraulic pump 20 as described, i.e., a primary pressure, whereas the other end of the pressure-compensating valve 41 is acted upon by hydraulic oil at the same pressure as the load pressure of the actuator, i.e., a secondary pressure plus a restoring force of the set spring 62. When the valve 41 is moved to position where the pressures are balanced, its movement is stopped.

In this case, the quantity of oil to be sent to the actuators regulating the primary pressure is regulated by the opening degree of the passage hole 38 which is formed by various engagements between the land portions 45,46 and the inner peripheral surfaces of the bores 5,6,7. At that time, a part of the hydraulic oil flows through the interior of the passage hole 43 and is guided to the blocked ends of the pressure-compensating bores 5,6,7 in order to act on one end of the pressure-compensating valve 41.

For example, when the load pressure is increased due to load fluctuation of the actuators, the hydraulic oil within the oil passage 13 is introduced into the pressure-compensating bore 7 between the fixing bolt 57 and the shuttle housing 60. When a resultant force of the hydraulic oil and the set spring 62 exceeds the counter-pressure acting on one end of the pressure-compensating valve 41, the valve 41 is moved in the right-hand direction in FIG. 4.

Therefore, the opening degree to the feed oil passage 21 defined by the land portions 45,46 is increased. Since the quantity of oil sent to the send oil passage 18 is increased, the pressure within the oil passage 18 is increased. As a result, the pressure difference between the oil passage 13 and the send oil passage 18, which are disposed before and after the passage 27, gradually approaches an initially established value.

On the other hand, when the load pressure of the actuators is decreased, the resultant force of the hydraulic oil within the pressure-compensating bore 7 plus the force of set spring 62 becomes lower than the counter-pressure acting on the one end of the pressure-compensating valve 41 and the valve 41 is moved in the left-hand direction in FIG. 4.

Therefore, the opening degree of the feed oil passage 21 is decreased. Since the quantity of oil sent to the send oil passage 18 is decreased, pressure in the oil passage 18 is decreased. As a result, the pressure difference between the port 11 and the send oil passage 18, which are disposed before and after the passage 27, gradually approaches an initially established value.

Therefore, even if a load fluctuation of the actuators occurs or even if the opening degree of the passage 27 to the oil passage 13 is constant, the pressure difference between the oil passage 13 and the send oil passage 18, which are disposed before and after the passage 27, can be maintained constant. Since the quantity of oil passing through the passage 27 is correctly regulated, the speed of operation of the actuators is not changed.

On the other hand, the pressure of the hydraulic oil introduced into the respective pressure-compensating bores 5,6,7 from the respective control oil passages 19 as mentioned is different depending on the load of each actuator. The hydraulic oil flows to the shuttle housing 60 side through the respective annular oil passages 51 in order to act on the shuttle valves 66 which are contained in some housings 60.

Since hydraulic oil is introduced into the innermost pressure-compensating bore 5 through two different paths, the shuttle housing 60 accommodated in the bore 5 does not contain the shuttle valve 66. Therefore, the hydraulic oil introduced into the bore 5 in order to be fed to the corresponding actuators flows into the selected-load pressure transmitting oil passage 23 via the annular oil passage 64 formed at the end portion side of the housing 60 and then flows downstream through the oil passage 23.

The hydraulic oil is guided through the oil passage 23, to the shuttle housing 60 mounted in the pressure-compensating bore 6 at its downstream side, then through the conduit hole 72 through the depressed hole 71 opening through the peripheral surface thereof, and then into the valve chest 65 in order to act against one end of the valve body 67.

On the other hand, hydraulic oil guided into the pressure-compensating bore 6 so as to be fed to the actuator corresponding to the bore 6 is guided to the valve chest 65 through the passage hole 68 of the stop screw 69 and acts against the other end of the valve body 67. That is, both ends of the valve body 67 are acted upon, respectively, by the pressure of the actuators and the pressure in the pressure-compensating bores 5,6, such that the hydraulic oil pushes the valve body 67 toward the high pressure side, to thereby block the opening portion at the low pressure side.

In this way, when the high pressure side of the load pressure has been selected by the shuttle valve 66, the hydraulic oil passes through the peripheral surface of the valve body 67, then flows again into the pressure-selected oil passage 23 through the outlet port 74 and then to the downstream side through the oil passage 23.

The high pressure side hydraulic oil is guided into the oil passage 23 in the same manner as described, moves to the shuttle housing 60 mounted in the pressure-compensating bore 7 at its downstream side, flows through the conduit hole 72 through the depressed hole 71 opening through the peripheral surface thereof in the same manner as described, and then flows into the valve chest 65 in order to act against one end of the valve body 67.

On the other hand, hydraulic oil guided into the pressure-compensating bore 7 so as to be fed to the actuator, which corresponds to the bore 7, is guided into the valve chest 65 through the passage hole 68 of the stop screw 69 in the same manner as described and acts on the other end of the valve body 67 within the valve chest 65. That is, both ends of the valve body 67 are acted upon with load pressure of the actuator corresponding to pressure in the pressure-compensating bore 7 and pressure of the actuator to which the pressure-selected hydraulic oil is fed, and the valve body 67 is moved by the hydraulic oil at the high pressure side, to thereby block the opening portion at the low pressure side. As a result, pressure at the high pressure side is selected.

In this way, the pressure selected by the final shuttle valve 66 corresponds to the maximum load pressure among the load pressures of all the actuators. This hydraulic oil then flows through the peripheral surface of the valve body 67, into the selected-load pressure transmitting oil passage 23 through the outlet port 74, and is then guided into the unload valve 22 from the oil passage 23 through the oil passage in order to control the pump discharging pressure (primary pressure) to the oil conduit tube 77.

That is, in case the pressure of the hydraulic oil guided into the unload valve 22 is low as, for example, when all the actuators are in a low load state, the unload valve 22 is communicated with the oil tank 8 to return hydraulic oil to the oil tank 8, to thereby decrease the consumption of power by the hydraulic pump 20. On the other hand, in case the pressure of the hydraulic oil is high due to a high load state of the actuators, communication with the oil tank 8 is cut off, and oil is discharged by the hydraulic pump 20, i.e., hydraulic oil under high pressure, under a pressure which is normally higher than the pressure-selected high pressure corresponding to the pressure set by the set spring mounted on the unload valve 22, and is fed to the actuator.

Therefore, hydraulic oil under a pressure corresponding to the maximum load pressure of the actuators is fed to the feed oil passage 21, and therefore, the plurality of actuators can be actuated simultaneously.

In the above-mentioned embodiment, the present invention has been applied to a mono-block type directional control valve. However, it may be applied to a stack type directional control valve. Also, the load check valve used in the above-mentioned embodiment may be omitted.

What is claimed is:

1. A control valve for use in controlling flow of hydraulic fluid from a hydraulic pump to a plurality of actuators, comprising:

A valve housing having formed therein a plurality of spaced apart parallel control bores formed along a first plane, a plurality of spaced apart parallel pressure-compensating bores formed along a second plane spaced from and parallel to said first plane, said plurality of control bores corresponding in number to said plurality of pressure-compensating bores so as to form a plurality of control bore/pressure-compensating bore pairs, a feed passage formed along said second plane, perpendicular to said plurality of pressure-compensating bores, and providing fluid communication between respective first ends of said plurality of pressure-compensating bores, a single selected-load pressure transmitting passage formed along said second plane, perpendicular to said plurality of pressure-compensating bores, and providing fluid communication between respective second ends of said plurality of pressure-compensating bores, a pair of return passages formed along said first plane, perpendicular to said plurality of control bores, and providing fluid communication between said plurality of control bores and a reservoir tank, a plurality of control passages, each of said plurality of control passages interconnecting said control bore and said pressure-compensating bore of a respective one of said plurality of control bore/-pressure-compensating bore pairs, a pair of spaced apart feeding and exhausting passages communicating with, respectively, each of said plurality of control bores, and a plurality of actuator ports, said plurality of actuator ports communicating with said plurality of feeding and exhausting passages, respectively, and being adapted to communicate with respective ones of the plurality of actuators;

a plurality of control valve spools slidably mounted within said plurality of control bores, respectively;

a plurality of pressure-compensating valves slidably mounted within said plurality of pressure-compensating bores, respectively, such that one end of each of said plurality of pressure-compensating valves is subject to fluid pressure from the hydraulic pump through said feed passage and another end of each of said plurality of pressure-compensating valves is subject to fluid pressure due to loads of respective ones of the actuators through said plurality of control passages, respectively;

a plurality of shuttle valves mounted in respective intersections of at least some of said plurality of pressure-compensating bores and said selected-load pressure transmitting passage, each of said plurality of shuttle valves including a valve chest formed with a first fluid opening communicating with an upstream side of said selected-load pressure transmitting passage, a second fluid opening communicating with a downstream side of said selected-load pressure transmitting passage, and a third fluid opening communicating with a respective one of said plurality of control passages, each of said plurality of shuttle valves further including a valve element mounted within said valve chest for movement between a first position in which said shuttle valve allows communication between said upstream and downstream sides of said selected-load pressure transmitting passage and a second position in which said shuttle valve allows communication between a respective one of said plurality of control passages and said downstream side of said selected-load pressure transmitting passage; and an unload valve means for connecting said feed passage with the reservoir tank when a maximum load pressure among all of the plurality of actuators is within a predetermined range of pressures.

2. A control valve as recited in claim 1, wherein said plurality of pressure-compensating bores comprises three pressure-compensating bores; and said plurality of shuttle valves comprises two shuttle valves, each mounted in a respective one of two of said three pressure-compensating bores.

3. A control valve as recited in claim 1, wherein each of said plurality of control bores is parallel to each of said plurality of pressure-compensating bores.

4. A control valve as recited in claim 3, wherein said first and second planes are aligned one above the other.

5. A control valve as recited in claim 1, wherein each pair of feeding and exhausting passages is formed perpendicular to said first plane, perpendicular to said plurality of control bores, and is adapted to communicate with the reservoir tank.

6. A control valve as recited in claim 1, further comprising a bull plug inserted in a first end of each of said feed passage and said selected-load pressure transmitting passage.

7. A control valve as recited in claim 1, wherein each of said pressure-compensating bores extends from a location where it intersects with said feed passage to a location where it opens through an end face of said valve housing.

8. A control valve as recited in claim 7, further comprising a shuttle housing mounted within each of said pressure-compensating bores at said location where said pressure-compensating bores open through said end face of said valve housing; and wherein, in each of said pressure-compensating bores in which one of said shuttle valves is mounted, said shuttle valve is mounted within said shuttle housing.

9. A control valve as recited in claim 1, wherein said valve housing includes a plurality of outer faces; and each of said plurality of control bores, said plurality of pressure-compensating bores, said feed passage, said selected-load pressure transmitting passage and said feeding and exhausting passages is formed so as to be substantially perpendicular to at least one of said outer faces of said valve housing and so as to be substantially parallel to at least one of said outer faces of said valve housing.

* * * * *